US006107940A

United States Patent [19]

Grimm

[11] Patent Number: 6,107,940

[45] **Date of Patent: *Aug. 22, 2000**

[54] METHOD FOR TRANSMITTING TRAFFIC INFORMATIONS FOR A DRIVER OR A VEHICLE INCLUDING MAXIMUM SPEED INFORMATION

[75] Inventor: Wolfgang Grimm, Leonberg, Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/152,963

[22] Filed: Sep. 14, 1998

[30] Foreign Application Priority Data

Sep. 18, 1997 [DE] Germany ..... 197 41 033

[51] Int. Cl.[7] ..... G08G 1/09

[52] U.S. Cl. ..... 340/905; 340/906; 340/928; 340/436; 340/438; 340/439; 364/449; 342/357

[58] Field of Search ..... 340/905, 928, 340/906, 438, 439, 936, 441; 364/449; 701/213; 342/357; 180/171

[56] References Cited

U.S. PATENT DOCUMENTS

| | | | |
|---|---|---|---|
| 3,686,628 | 8/1972 | Keller et al. | 340/53 |
| 4,591,823 | 5/1986 | Horvat | 340/53 |
| 4,962,457 | 10/1990 | Chen et al. | 364/443 |
| 5,179,519 | 1/1993 | Adachi et al. | 364/449 |
| 5,221,925 | 6/1993 | Cross | 340/988 |
| 5,424,727 | 6/1995 | Shieh | 340/928 |
| 5,452,217 | 9/1995 | Kishi et al. | 364/449 |
| 5,493,291 | 2/1996 | Brueggemann | 340/905 |
| 5,757,285 | 5/1998 | Grabow et al. | 340/928 |
| 5,774,830 | 6/1998 | Tsuji | 701/213 |
| 5,777,565 | 7/1998 | Hayashi et al. | 340/928 |
| 5,784,006 | 7/1998 | Hochstein | 340/905 |
| 5,819,198 | 10/1998 | Peretz | 701/117 |
| 5,831,575 | 11/1998 | Gu | 342/357 |
| 5,872,520 | 2/1999 | Seifert et al. | 340/825.34 |
| 6,008,740 | 12/1999 | Hopkins | 340/905 |

FOREIGN PATENT DOCUMENTS

| | | | |
|---|---|---|---|
| 0 045 044 | 2/1982 | European Pat. Off. | G08G 1/01 |
| 0 135 740 | 4/1985 | European Pat. Off. | G08G 7/09 |
| 0 618 557 A1 | 10/1994 | European Pat. Off. | G08G 1/0967 |

OTHER PUBLICATIONS

Publication :Auto Der Zukunft Denkt Mit, Jun. 4, 1996, Sduwest Presse.

*Primary Examiner*—Jeffery A. Hofsass
*Assistant Examiner*—Tai Tan Nguyen
*Attorney, Agent, or Firm*—Michael J. Striker

[57] ABSTRACT

For transmitting traffic informations for a driver of a vehicle a detection and recording device is provided in a vehicle, informations are requested wirelessly by the detection and recording device from transmission devices arranged in a roadway or on a roadway edge, and supplying an energy for an information transmission is supplied by the detection and recording device.

12 Claims, 1 Drawing Sheet

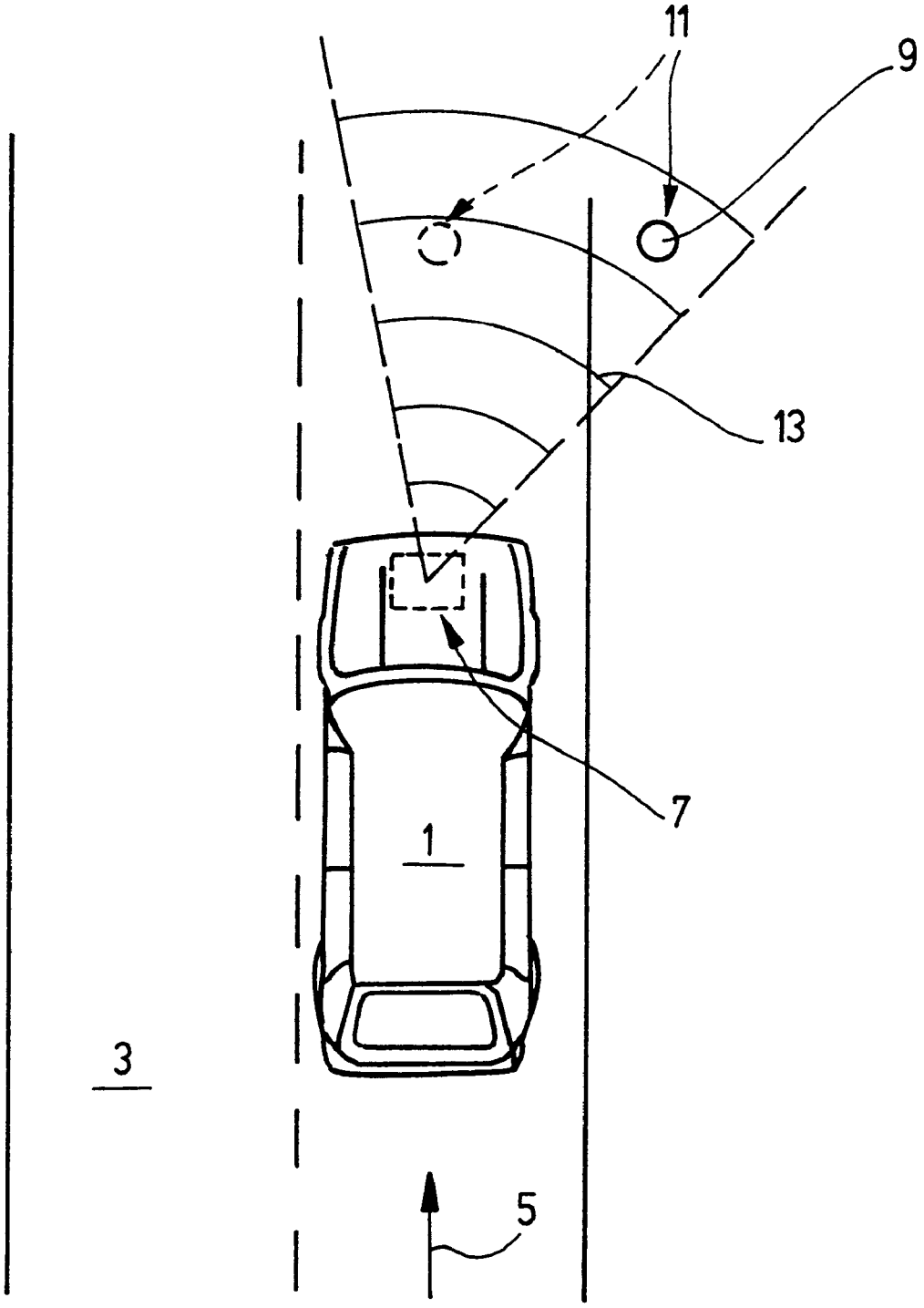
11
9
13
7
1
3
5

METHOD FOR TRANSMITTING TRAFFIC INFORMATIONS FOR A DRIVER OR A VEHICLE INCLUDING MAXIMUM SPEED INFORMATION

BACKGROUND OF THE INVENTION

The present invention relates to a method for transmitting traffic informations for a driver of a vehicle.

The publication of Südwest Presse, "Auto der Zukunft denkt mit", of Jun. 4, 1996 discloses a vehicle which has an autopilot. It deterines informations about a distance to objects on a roadway and tracks of the vehicle by means of a video camera arranged on a vehicle and image processing algorithms. Furthermore, traffic signs identified by the video camera can be recognized. It has been determined that it is disadvantageous that the image processing is frequently not reliable. Moreover, high investments are needed.

SUMMARY OF THE INVENTION

Accordingly, it is an object of the present invention to provide a method of transmitting traffic informations for a driver of a vehicle, which avoids the disadvantages of the prior art.

In keeping with these objects and with others which will become apparent hereinafter, one feature of present invention resides, briefly stated, in a method for transmitting traffic informations for a driver of a vehicle, wherein a detection and recording device located in/on the vehicle wirelessly requests informations from a transmitting device arranged in a roadway or on a roadway edge, the vehicle cyclically sends a reading (sensing) signal, and the energy for an information transmission is supplied by the detection and recording device.

The traffic information, for example permissible maximum speed, override prohibition, subsequent street traffic and the like can be requested during driving very fast. The reliability of informations which are transmitted by the transmitting devices and evaluated by the detection and recording device is very high. The recording for the driver of the vehicle or the vehicle occupant can be performed optically and/or acoustically. In other words, the detection and recording device can be a displays a horn/buzzer, an audio response unit and the like. Since energy required for the information transmission is supplied by the detection and recording device, the construction of the transmission devices can be simplified since additional energy sources, such as for example, batteries can be dispensed with. Therefore the manufacturing and operating costs can be reduced.

In accordance with a preferable embodiment of the invention, the detection and recording device transmits a request signal to the transmitting device. The request signal can be converted in/by the transmission device, and supplied back as a response signal to the detection and recording device. The transmission device is activated by the a request signal and located in a passive condition (stationary/ready position). The response signal includes at least one information, but also can contain several, for example two or three informations, for example a speed limit, data for subsequent driving in further street traffic. The request and the response signal can be for example an ultrasound, an electrical field or an optical signal.

Preferably, in accordance with one embodiment of the inventive method, the transmission device transmits a coded response signal to the detection and recording device, which is evaluated by it. By means of a software of the detection and recording device a meaning corresponding to a traffic information, which is recorded by the driver of the vehicle, is associated with the code.

In accordance with a further embodiment of the inventive method, for transmission of an information, several transmission devices are utilized. Thereby the reliability of the detection of the proper traffic information is guaranteed. One variant for the transmission of the traffic information is that the request of the transmission devices must be performed for example in definite time intervals in a fixed sequence, so that the detected information is accepted as a true information by the detection and recording device. It is also possible that a transmission device can request only a part of an information, so that during requesting all transmitting devices used for transmission of an information accept or determine a true information from the detection and recording device.

In accordance with a further preferable embodiment of the invention, the additional informations are processed by the detection and recording device. The additional informations can be for example supplied from a satellite navigation system (GPS or global positioning system), for example a driving direction of the vehicle determined by the GPS system.

Furthermore, in accordance with another embodiment of the invention, the reliability of the determination of all relevant informations is guaranteed by a redundant operation of the transmission devices.

Finally, in accordance with another embodiment of the invention, each transmission device is formed as a passive transponder, in particular a surface wave sensor. In connection with the present invention, the expression "passive transponder" means a response/transducer device which communicates wirelessly with the detection and recording device and does not have its own energy supply, for example a battery. Thereby, the passive transponder can be arranged in the places which are difficult to access.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a plan view of a vehicle with a detection and recording device for an inventive method in accordance with an embodiment of the present invention.

DESCRIPTION OF PREFERRED EMBODIMENTS

A method in accordance with present invention is illustrated in connection with a vehicle. It can be understood that it can be a passenger car, only as an example.

The single FIGURE of the drawings is a plan view of a vehicle which is identified with reference numeral 1 and formed as a passenger vehicle, driven on a roadway 3 in direction of an arrow 5. The vehicle 1 has a detection and recording device 7 identified in a broken line. It is arranged in the region of the front axle of the vehicle. The arrangement of the detection and recording device is arbitrary. It can be also arranged in a passenger space or in a vehicle rear part. The detection and recording device 7 includes a display which is recognizable from the position of a driver and serves for indication of traffic informations as will be explained herein below.

As can be seen from the drawings, a transmission device 11 is arranged at the right edge of the roadway 3 and formed as a surface wave sensor 9. In accordance with another embodiment, as shown in a broken line, it is integrated in the roadway 3. One or several traffic informations are stored in the surface wave sensor 9, for example a permissible maximum speed, a dangerous narrowing and the like. They can be requested by means of the detection and recording device 7 during driving of the vehicle 1 by the driver.

The surface wave sensor 9, which can be formed as an interdigital convertor is composed of a pietzo electric single crystal provided (not shown in the drawings)with comb-shaped interengaging microstructures provided on its surface. A row of a reflectors arranged on the surface of the crystal are similar to the lines of a bar code. Each reflector corresponds to one bit with the value one, and a gap is coded as zero. The operation of the surface wave sensor 9 will be illustrated later on with respect to an information transmission from the transmission device 11 to the detection and recording device 7.

The detection and recording device 7 produces an electrical impulse through a not shown antenna in direction toward the transmitting device 11, or in other words an electrical field 13. It causes a mechanical deformation in the crystal, which propagates as an acoustic wave on the surface of the crystal. A small part of the acoustic wave is reflected on each reflector located on the surface of the crystal. The surface of the crystal converts the successively occurring echos of the acoustic wave in a sequence of electrical signals which are radiated by a not shown antenna. With the time intervals of the signals, the detection and recording device can reconstruct the binary pattern and indicate the information or informations of the display.

In accordance with a preferable embodiment of the invention, the traffic information or informations are automatically requested by the detection and recording device from the transmission device. For example, the driver who overlooked a speed limit receive an acoustic or optical indication when he exceeds the prescribed speed. Thereby a high reliability for the driver of the vehicle is guaranteed.

The transmission devices can be used additionally. It is also possible to dispense with the traffic signs at least partially and to replace the same by the transmission devices. Thereby on one hand the cost for the roadway is reduced, and on the other hand, aesthetics of the landscape image is utilized.

The transmission of traffic informations by means of the detection and recording device 7 and the transmission device 11 makes possible a fast and reliable detection of informations, which are shown on traffic signs. Moreover, the vehicles already in operation can be equipped additionally in a simple and cost favorable manner with the detection and recording device. Therefore stated the detection and recording device improves unloading of a driver of a vehicle and thereby contributes to the reliability of the street traffic.

It will be understood that each of the elements described above, or two or more together, may also find a useful application in other types of methods differing from the types described above.

While the invention has been illustrated and described as embodied in method of transmitting traffic informations for a driver of a vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for transmitting traffic information for a driver of a vehicle, comprising the steps of providing a detection and recording device in a vehicle; requesting wirelessly information by the detection and recording device from a transmission device arranged in a roadway or on a roadway edge, said transmission device storing information about a permissible maximum speed; supply energy for an information transmission by the detection and recording device; processing additional information by the detection and recording device; and supplying the additional information from a satellite navigation system, said detection and recording device automatically requesting the information about a permissible maximum speed from said transmission device and providing an indication when the vehicle exceeds the permissible maximum speed.

2. A method as defined in claim 1; and further comprising transmitting a request signal by the detection and recording device to the transmission device; converting the request signal by the transmission device; and sending back as a response signal to the detection and recording device.

3. A method as defined in claim 1; and further comprising transmission by the transmitting device a coded response signal to the detection and recording device; and evaluating the coded signal by the detection and recording device.

4. A method as defined in claim 1; and further comprising using a plurality of the transmission devices for transmission of information.

5. A method as defined in claim 1; and further comprising redundantly operating the transmission device for guaranteeing a reliability of a detection of all relevant information.

6. A method as defined in claim 4; and further comprising forming each transmission device as a passive transducer.

7. A method as defined in claim 4; and further comprising forming each of the transmission devices as a surface wave sensor.

8. A method as defined in claim 1, wherein said indication is selected from the group consisting of an acoustic indication and an optical indication.

9. A system for transmitting traffic information for a driver of a vehicle, comprising a transmission device arranged in a roadway or on a roadway edge, said transmission device storing information about a permissible maximum speed; a detection and recording device located in a vehicle and formed so that ft wirelessly requests information from the transmission device, said detection and recording device being formed so that it supplies energy for an information transmission between said transmission device and said detection and recording device; and means for supplying additional information from a satellite navigation system so that said detecting and recording device processes the additional information, said detection and recording device automatically requesting the information about a permissible maximum speed from said transmission device and providing an indication when the vehicle exceeds the permissible maximum speed.

10. A system as defined in claim 9, wherein said indication is selected from the group consisting of an acoustic indication and an optical indication.

11. A method for transmitting traffic information for a driver of a vehicle, comprising the steps of providing a detection and recording device in a vehicle, requesting wireless information related to a driving direction of the vehicle by the detection and recording device from a plurality of transmission devices arranged in a roadway or on a roadway edge in definite time intervals in a fixed sequence, which transmission devices store information about a permissible maximum speed; supplying energy for information transmission by the detection and recording device; automatically requesting by the detection and the recording device from the transmission devices information about the permissible maximum speed, and in the event if the vehicle exceeds the permissible maximum speed producing an indication to a driver about exceeding of the permissible maximum speed.

12. A system for transmitting traffic information for a driver of a vehicle, comprising a plurality of transmission devices arranged in a roadway or on a roadway edge , said transmission devices storing information about a permissible maximum speed; a detection and recording device located in a vehicle and formed so that it wirelessly requests information related to a driving direction of the vehicle from the transmission devices in definite time intervals in a fixed sequence, said detection and recording device being formed so that it supplies energy for an information transmission between said transmission devices and said detection and recording device; and means for supplying additional information so that said detecting and recording device processes the additional information, said detection and recording device automatically requesting the information about a permissible maximum speed from said transmission devices and provides an indication when the vehicle exceeds the permissible maximum speed.

* * * * *